United States Patent [19]

Smith et al.

[11] Patent Number: 4,568,039

[45] Date of Patent: Feb. 4, 1986

[54] GUIDANCE SYSTEM FOR A PROJECTILE

[75] Inventors: John A. Smith, Bedford, Mass.; Ronald R. Sinclair, Moultonboro, N.H.

[73] Assignee: Sanders Associates, Inc., Nashua, N.H.

[21] Appl. No.: 392,717

[22] Filed: Aug. 10, 1973

[51] Int. Cl.[4] ..... F41G 7/22

[52] U.S. Cl. ..... 244/3.15

[58] Field of Search ..... 244/3.16, 3.21; 102/70.2 P, 213, 214

[56] References Cited

U.S. PATENT DOCUMENTS

| | | | |
|---|---|---|---|
| 3,021,096 | 2/1962 | DeMott | 244/3.16 |
| 3,065,931 | 11/1962 | Dixon et al. | 244/3.16 |
| 3,504,869 | 4/1970 | Evans et al. | 244/3.21 |

*Primary Examiner*—Charles T. Jordan

*Attorney, Agent, or Firm*—Louis Etlinger; Richard I. Seligman

[57] ABSTRACT

Guidance is provided for a spinning projectile by measuring the magnitude of the angle between the spinning projectile and a target. This information is processed in conjunction with a body rate sensor to deduce the angular rate of the line of sight between projectile and the target. A means is provided for reducing the line of sight angular rate to zero, thus ensuring that the projectile will intercept the target.

6 Claims, 12 Drawing Figures

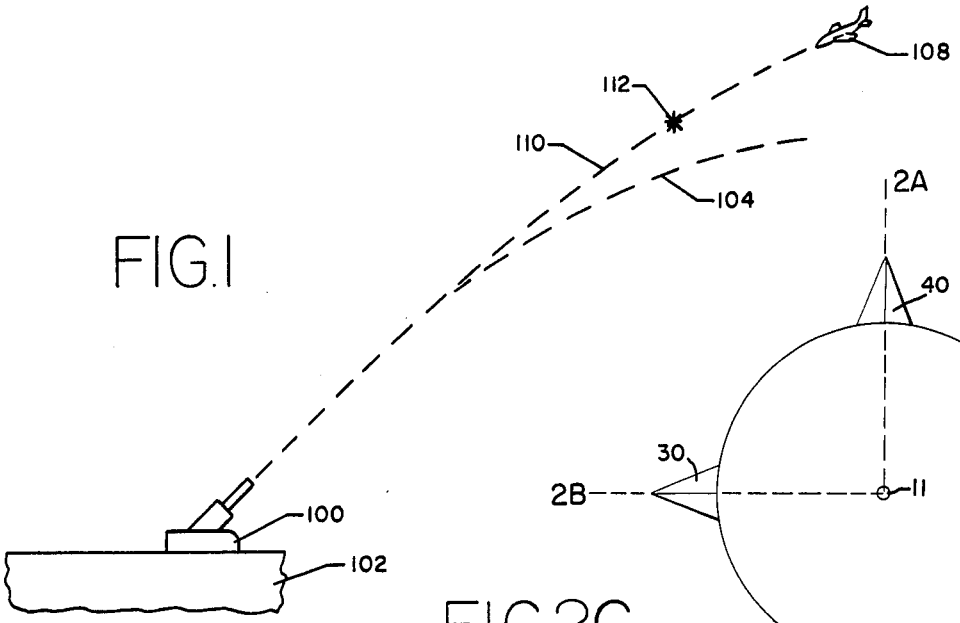
FIG.1
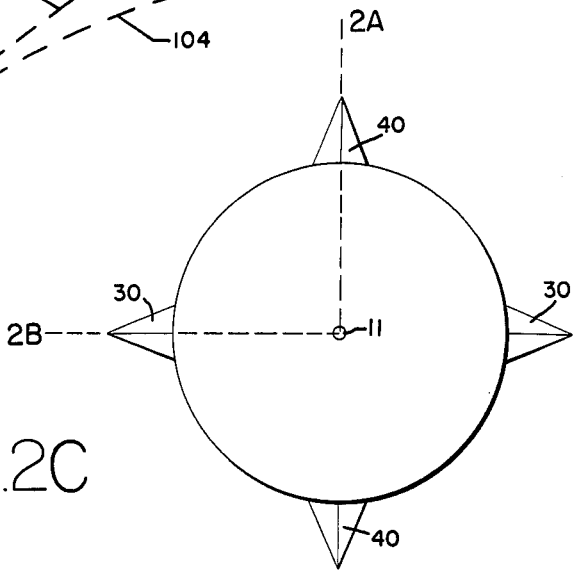
FIG.2C
FIG.2A
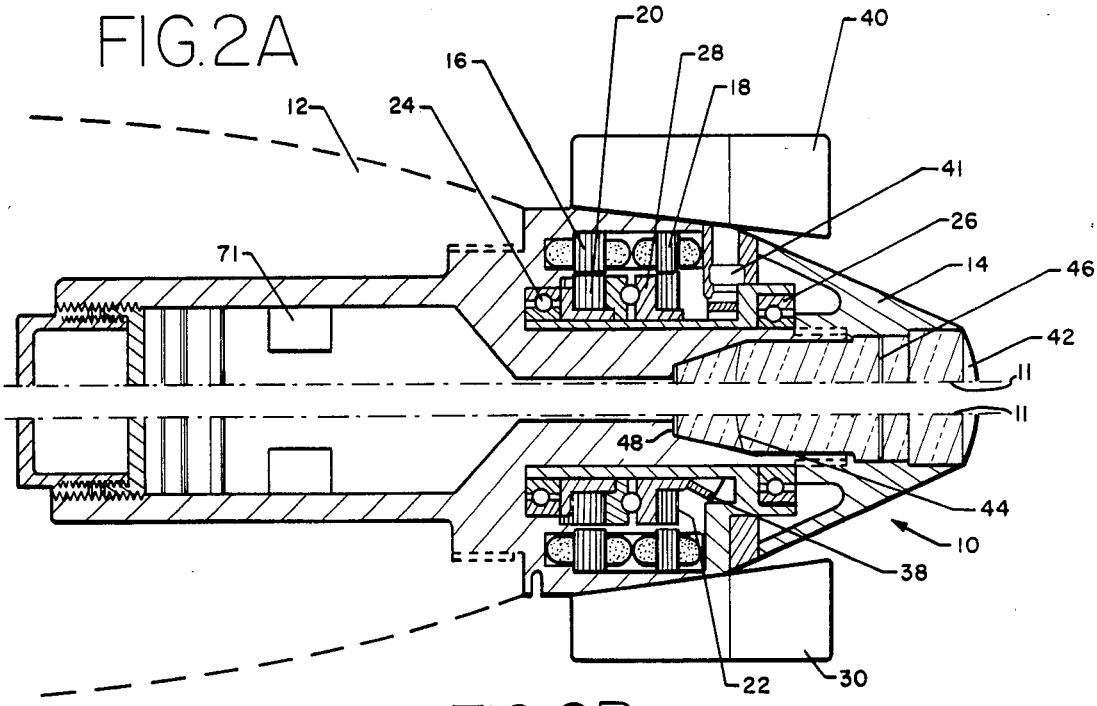
FIG.2B

GUIDANCE SYSTEM FOR A PROJECTILE

BACKGROUND OF THE INVENTION

The present capability of gun fire-control systems for point defense against antiship missiles is limited by normal gun system errors and the number of projectiles that can be fired during a short engagement. For this reason guided missiles are used as a defense against antiship missiles. However, the effectiveness of such guided missiles is limited to a minimum range of several miles. Furthermore, they can be used only on specially equipped missile ships. The employment of antiship missile systems aboard a ship requires that major and expensive modifications be made to the ship or that the ship be particularly designed for the missiles.

Guided spinning shells have been conceived to alleviate some of these problems. However because they are not compatible with existing shipboard guns they also require major ship modifications. Also, the guidance system for such spinning shells have been of the pursuit course navigation type which has proved ineffective against moving targets. Pursuit course navigation requires for major corrections in ballistic path to be made in the latter part of the flight, at a time when maximum lift necessary to make the correction is often not available.

SUMMARY OF THE INVENTION

Accordingly, it is an object of this invention to provide a guidance system for a spinning projectile which is well within the projectiles capability of performance;

It is another object of this invention to provide a guidance system for conventional gun-fired projectiles;

Briefly, the above objects are achieved by providing, in a spinning projectile an optical sensor for detecting the position of a target, electronic means for generating an electrical signal which is proportional to the magnitude of the angle between the spin axis of the projectile and the line-of-sight to the detected target, and means including deflectable canards for altering the trajectory of the projectile to hold the aforementioned line-of-sight angle rate at zero value. A rate gyro is employed to measure the angular rate of the projectile to determine the actual inertial line-of-sight rate.

BRIEF DESCRIPTION OF THE DRAWINGS

The above-mentioned and other features and objects of this invention will become more apparent by reference to the following description taken in conjunction with the accompanying drawings, in which:

FIG. 1 is a drawing illustrating the principles of a terminal guidance system for a spinning projectile;

FIGS. 2A and 2B are sectional views illustrating two different quarter sections of a terminal guidance system for a projectile;

FIG. 2C is a sketch illustrating the orientation of the cutting planes for FIGS. 2A and 2B;

DESCRIPTION OF PREFERRED EMBODIMENT

Figure 3:
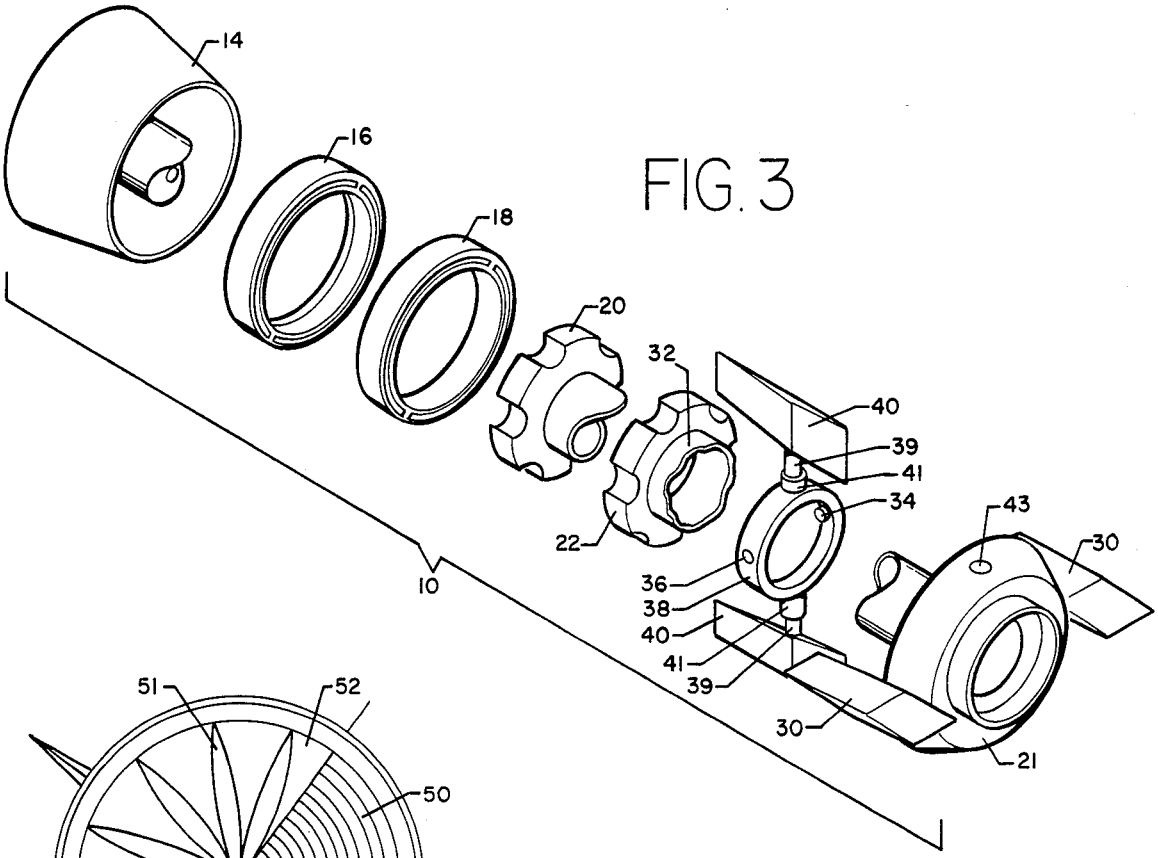
FIG. 3 is a perspective exploded view illustrating the major components of the canard control assembly of FIGS. 2A and 2B.

The concept of providing terminal guidance for standard gun-fired spin stabilized shells is illustrated in FIG. 1 in conjunction with a shipboard application. However, the invention is applicable for any gun-fired, spin stabilized projectile whether land, sea or air launched. The concept is also useful for spinning rockets. The projectile is a standard shell with the novel device substituted for the fuze and being threaded into the fuze well. The device has canards thereon to alter the trajectory of the shell.

The projectile is fired from a conventional gun 100 located aboard a ship 102. When fired, the shell travels along a trajectory 104. An optical sensor located in the front of the projectile detects the position of a target 108. Electronic signals generated proportional to the detected target position are processed and applied to the canard mechanism to alter the trajectory of the shell to a new trajectory 110 which will greatly improve probability of target intercept at position 112. Continuous correction can be made during any single shell firing.

Referring now to FIGS. 2A–2C and 3, there is illustrated thereby a preferred embodiment of the invention. FIG. 2A is a 90° cut through the center line 11 of the device and FIG. 2B is a 180° cut. The cutting planes are shown in FIG. 2C. The device 10 for providing terminal guidance to a ballistic projectile is a self-contained unit that threads into the fuze well of a standard shell 12. The device comprises a main housing 14 which when fired from a gun spins at the rate of the shell to which it is attached. Attached to main housing 14 are first and second sets of stator windings 16 and 18. These windings are press fitted therein or may be attached in any other convenient manner. Positioned in cooperating relationship with the sets of windings 16 and 18 are first and second rotors 20 and 22.

The rotor assemblies 20 and 22 are supported by a pair of bearings 24 and 26 also press fitted into the main housing. For clarity purposes the bearings are omitted in FIG. 3. A thrust bearing 28 positioned intermediate rotors 20 and 22 allows rotor 22 to rotate relative to rotor 20.

Attached to rotor 20 via a canard frame 21 are a pair of fixed canards 30. When the shell is fired from a gun the main housing 14 spins at the rate the shell is spinning while the air stream acts against the fixed canards 30 and a set of deflecting canards 40 to despin rotor 20 down to essentially zero RPM. In practice rotor 20 is actually made to spin in the opposite direction at a few RPM. To cause the fixed canards to rotate in a direction opposite that of the main housing at a few RPM, a slight cant is put into the fixed canards (on the order of less than one degree). Bearings 24 and 26 permit the relative motion between the rotors 20 and 22 and the main housing 14, and, thus, the spinning shell.

The shaft of rotor 22 has a cam surface 32 thereon which cooperates with a cam follower, coupling pins 34 and 36. These pins are attached to a yoke having a pair of deflecting canards 40 mounted thereon. In the example shown, the pins are spaced 180 degrees apart. Yoke 38 has a pair of shafts 39 attached thereto which ride in a corresponding pair of bearings 41. These bearings are disposed within holes 43 in the canard frame 21.

The difference in spin rate between stator windings 16 (attached to the main housing) and rotor 20 provides an alternator or generator whereby all the electrical power required by the device 10 is generated, thus, eliminating any requirement for external supply of power as, for example, from a battery or springs. This arrangement is different from conventional generators in that the stator windings are spun and the rotor kept relatively fixed. Conventionally, the stator windings are fixed and the rotor is rotated.

In addition to supplying prime power for the device, the windings-rotor combination 16,20 is also used to provide control for the canard frame 30. For this purpose, the windings-rotor arrangement 16, 20 is used as a motor in that the load on the windings 16 is varied, thus, permitting a controlled rate of rotation of the canard frame. The canard frame is rotated in order to align the deflecting canards 40 in a direction whereby they can be used to deflect the shell in the desired direction. The load on the windings 16 is continuously adjusted to maintain the proper (desired) orientation.

The deflecting canards 40 are controlled by a motor made up of windings 18 and rotor 22. The windings 18 rotate with the spinning projectile while the rotor 22 is despun. Guidance control signals applied to the windings 18 cause the rotor to rotate up to $\pm 90$ degrees with respect to the rotor 20. This action activates cam 32 that rotates the canard yoke 38 up to $\pm 15$ degrees around the canard hinge axis thereby deflecting the canards up to $\pm 15$ degrees.

In this arrangement prime power is generated and canard orientation and proportional deflection is achieved without any electrical or mechanical connections other than bearings between the spinning and despun sections.

The target seeker comprises a sensor 42 which is attached to the spinning projectile and, therefore, rotates therewith, thus eliminating any requirement for a separate reticle motor as in conventional infrared target seekers. The sensor 42 includes curved lenses, a reticle 44 etched on the lens glass, a spectral filter 46 and a photocell detector 48.

The sensor is operated as a fixed-body seeker whose error signal is electrically stabilized by the guidance system to eliminate the requirement for a gimballed platform. The optical design provides a wide field of view (12° half angle).

Preferably, the sensor is made to operate in a dual mode, that is both in a passive infrared mode and a semiactive mode with a laser designator. For the dual mode application the detector 48 is a Si-PbS sandwiched detector. The PbS part of the sandwiched detector is used in the passive mode to track targets in the 2.0 to 2.5 micron band. The silicon part of the sandwiched detector is used in the semiactive mode to track targets illuminated by a laser designator. The silicon detector, transparent above 1.1 microns, detects the 1.06 micron, 200 watt CW signal transmitted from, for example, a ship and reflected off the target.

The sensor is a solid unit with individual components thereof cemented together so as to preclude any air gaps which would generate areas of high stress concentration at the acceleration levels which the device must withstand during firing.

Figure 4:
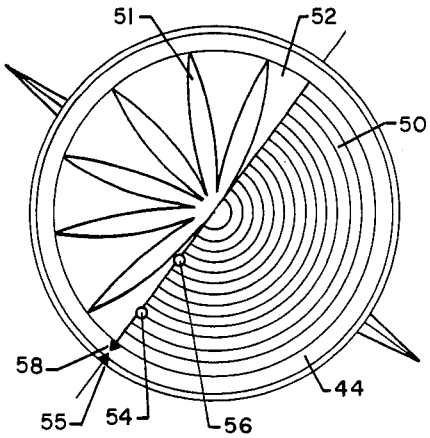
FIG. 4 is a plan view of a target seeker reticle employed in the canard control assembly of FIGS. 2A and 2B and illustrating the use thereof for orientating and deflecting the canards.

One embodiment of reticle 44 is illustrated in FIG. 4. This reticle consists of two semi-circles 50 and 52. Portion 50 is semi-transparent while portion 52 includes a radial encoding design 51. The reticle encodes the polar-coordinate position of the target image with respect to the common spin axis of the projectile and the optical axis of the sensor. Operation with reticle 44 is described in conjunction with the waveforms of FIG. 5 and the functional block diagram of FIG. 6.

Figure 5:
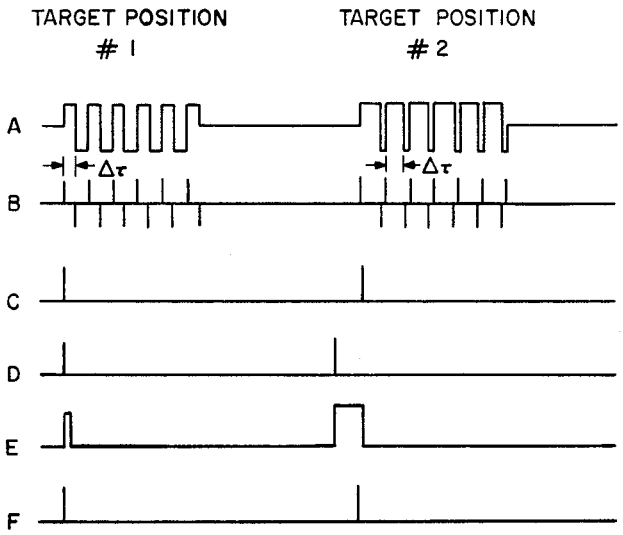
FIG. 5 is a series of waveforms illustrating operation of the target seeker.

When sensor 42 detects a target, detector 48 provides an output as shown in waveform A of FIG. 5. Note that two detected target positions are shown to illustrate how the signal changes dependent upon target position. In actuality only a single target is detected at any one time.

Waveform A indicates the target position with respect to the center line of the reticle. The pulses on the left of waveform A are from a target position 54 a relatively large distance away from the center of reticle 44 while the pulses on the right are from a target position 56 closer to the center of the reticle. By comparing the pulses of waveform A it is evident that the pulse width of the positive pulses increases as the target approaches the center of the reticle. This occurs since the portions 51 of the reticle section 52 predominate as the target nears the center of the reticle.

The pulses from a detected target as shown in waveform A of FIG. 5 are differentiated by a differentiator 60 to provide the signal shown in waveform B. The first pulse of waveform B is shown in waveform C and designated the target reference pulse and coincides with the target entering the radial encoder sector of the reticle. The frequency of the target reference pulses equals the spin rate of the projectile referenced to the target.

A reference pickup 58 which can be, for example, a coil located on the main housing, generates a pulse each time the projectile rotates past the canard frame (see waveform D). Pickup 58 provides output each time it passes a magnet 55 located on the canard frame. Since, as mentioned hereinbefore, a small cant on the fixed canards causes the canard frame to rotate counterclockwise at a rate of 0 to 10 revolutions per second, the frequency of the reference pulses will equal the spin rate of the projectile plus the rotational rate of the canard frame. These reference pulses (waveform D of FIG. 5) have a slightly higher frequency than the target reference pulses (waveform C).

The frequencies of the target reference pulse (waveform C) and the canard reference pulse (waveform D) are compared to generate an error signal (waveform E). This error signal is used to increase the alternator load, thus slowing the rotational rate of the canard frame.

When the canard reference frequency is equal to the target reference pulse frequency (waveforms C and F), the error signal is zero, and the canard frame will be stopped with respect to the target.

Figure 7:
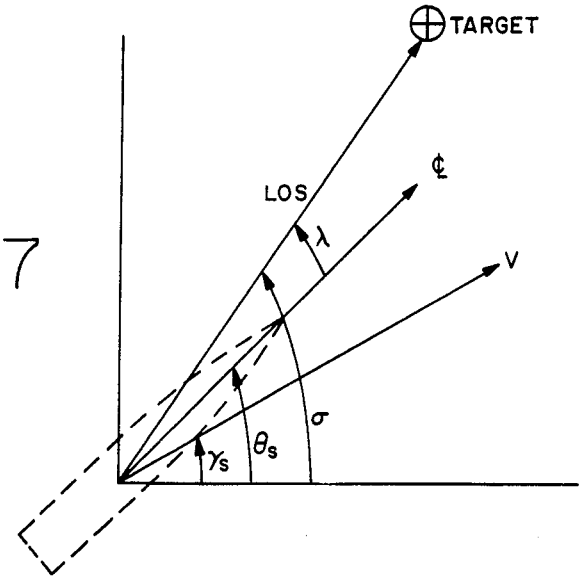
FIG. 7 is a diagram illustrating operation of the proportional navigation system in accordance with the invention.

The magnet 58 is located at the center line of one of the fixed canards and the reference pickup at the center line of the reticle so that when the canard reference pulse and the target reference pulse are coincident, the deflecting canards are oriented 90 degrees with respect to a plane containing the target line of sight. This is the correct orientation for correcting the projectile trajectory. The application of power to the canard deflection motor is the only operation remaining for starting the projectile trajectory The time interval between the positive and negative pulses from differentiator 60 are measured by unit 63. The six time intervals are averaged over one revolution of the projectile to attain a signal (time interval) that is directly proportional to the magnitude of the angle difference between the center line of the projectile (spin axis) and the line-of-sight of the target ($\lambda$) (see FIG. 7). The signal (analog voltage) resulting from the angle measurement is differentiated 68 and smoothed by filter 70 to provide the look angle rate ($\lambda^\circ$).

The look angle rate ($\lambda^\circ$) is equal to $\sigma^\circ$ plus $\theta^\circ$ where $\sigma^\circ$ is the line-of-sight rate in inertial space and $\theta^\circ$ is the shell pitch rate or yaw rate in inertial space. In order to provide the inertial line-of-sight rate ($\sigma^\circ$) the shell pitch rate or yaw rate ($\theta^\circ$) must be subtracted from the look angle rate ($\lambda^\circ$).

A rate gyro having its spin axis perpendicular to the spin axis of the projectile provides $\theta^\circ$ and the signal from the rate gyro is applied to a summer 72 along with $\lambda^\circ$ to provide the difference signal $\sigma^\circ$.

The difference output from summer 72 is amplified by an amplifier 74 and applied to windings 18 which deflect the deflecting canards 40.

What has been described with respect to the manner of deflecting the deflectable canards is a proportional navigation system wherein $\gamma^\circ = K\sigma^\circ$, $\gamma^\circ$ being the rate of projectile flight path angle. The object of such a system is to drive $\sigma^\circ$ to zero or, in other words, to maintain $\sigma$. If $\sigma$ is maintained, the projectile will hit the target.

Figure 6:
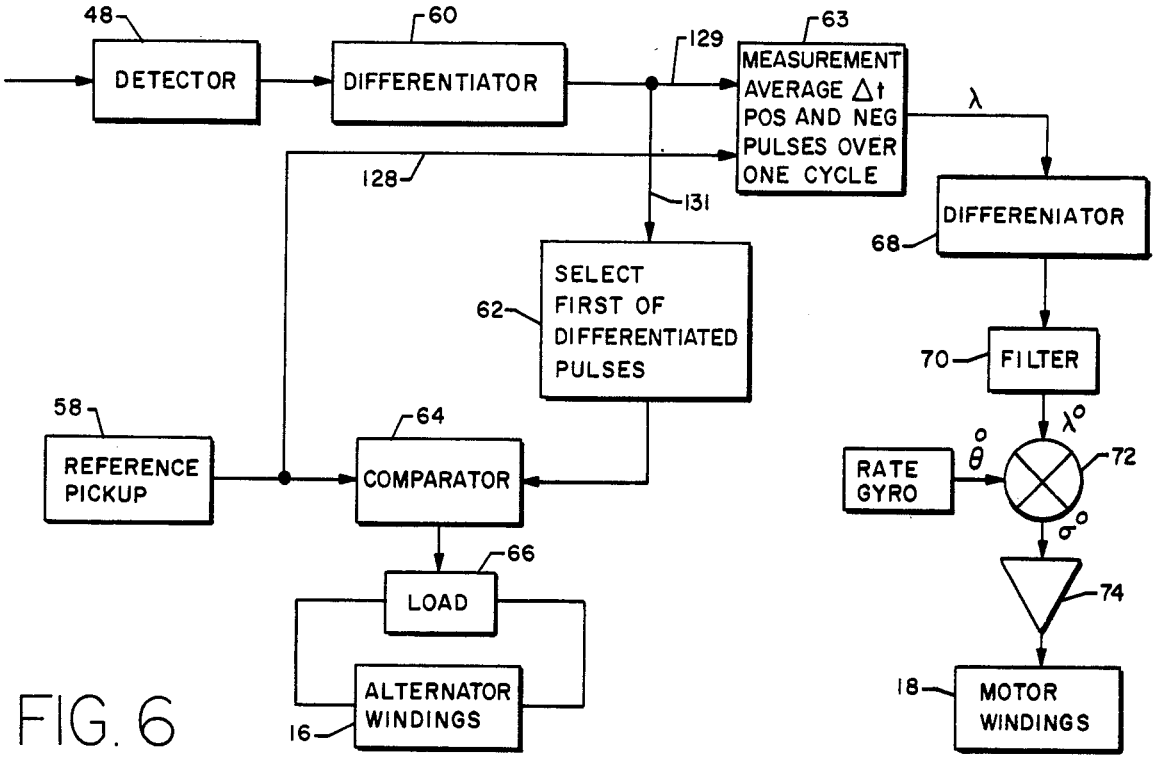
FIG. 6 is a functional block diagram of the electronics of the canard control assembly of FIGS. 2A and 2B.

The functional blocks of FIG. 6 are now described in greater detail.

Figure 8:
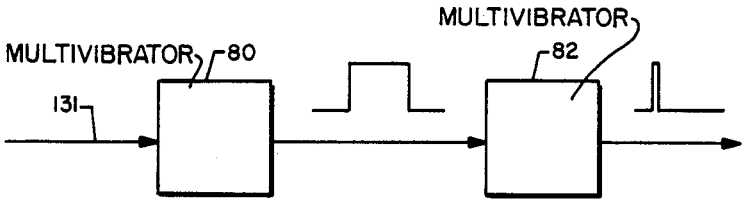
FIG. 8 is a block diagram of means 62 of FIG. 6.

BLOCK 62 which functionally selects the first of the differentiated pulses from differentiator 60 is shown in FIG. 8, and comprises a pair of monostable multivibrators 80 and 82. The differentiated output from differentiator 60 is applied to a first monostable multivibrator 80 which has a time delay of a length somewhat longer than the period from the first to the last pulse of waveform B of FIG. 5. Thus, monostable multivibrator 80 will be triggered on the first pulse from the differentiator 0 and will provide a pulse of width longer than that of the 3 differentiated pulses. This relatively long pulse is applied to a second monostable multivibrator 82 which is triggered on the leading edge of the pulse from monostable multivibrator 80, and it has a relatively short time delay to provide the pulse shown in waveform C of FIG. 5.

Figure 9:
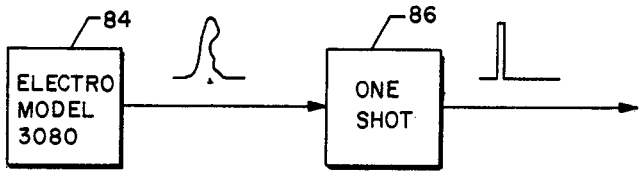
FIG. 9 is a block diagram of means 58 of FIG. 6.

The canard reference pulses, that is, the pulses illustrated in waveform D of FIG. 5, are generated by, for example, the mechanism shown in FIG. 9. A magnetic pickup 84 provides an output which is applied to a monostable multivibrator 86 to buffer the relatively noisy output of a pickup to provide the reference pulse. An electro/Model 3080 can be employed as the magnetic pickup. This is manufactured by Electro Corp., 1845 57 St., Sarasota, Fla.

Figure 10:
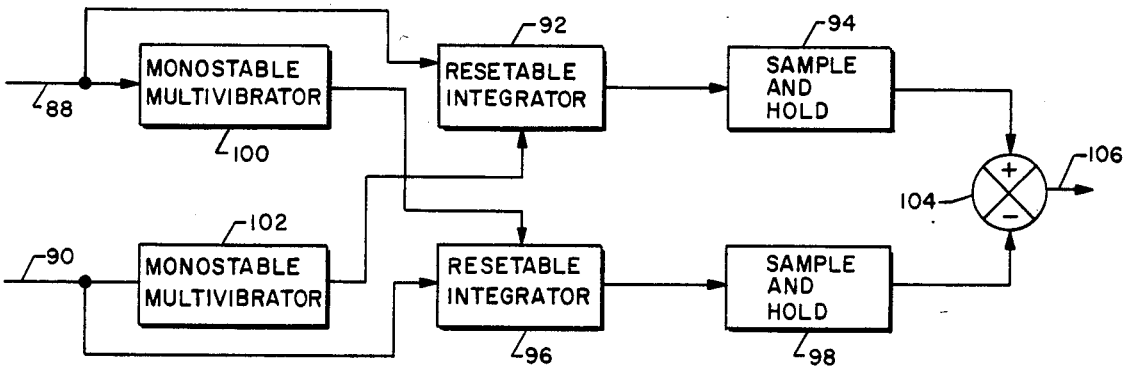
FIG. 10 is a block diagram of a comparator employed in FIG. 6.

The outputs from monostable multivibrators 86 and 82 are applied to comparator 64, which is illustrated in detail in FIG. 10. The output from the comparator 64 is proportional to any misalignment between the fixed canards and the targets, and provides a signal to properly orientate the fixed canards to the target.

The output from monostable multivibrator 82 is applied to input 88 of the comparator and the output from monostable multivibrator 86 is applied to input 90 of the comparator. The selected first differentiated pulse is applied to a resettable integrator 92, the output of which is applied to a sample and hold circuit 94. The reference pulse from input 90 is used to enable sample and hold circuit 94. Therefore, the first reference pulse after the selected differentiated pulse will cause circuit 94 to sample and hold the value of the resettable integrator 92. In like fashion, the reference pulse will be applied to a resettable integrator 96 whose output is applied to a sample and hold circuit 98. Sample and hold circuit 98 will sample the value in resettable 96 upon being enabled by the selected first differential pulse. The integrators 92 and 96 are reset by pulses from monostable multivibrators 100 and 102, which have a delay equal to 100 rs.

The values stored in sample and hold circuits 94 and 98 are applied to a summer 104 wherein the value in sample and hold circuit 98 is subtracted from the value in sample and hold circuit 94 providing an output 106 which is proportional to target to canard displacement. In one embodiment the resettable integrators were of the circuit types illustrated by Burr Brown 4013/25 manufactured by Burr Brown Research Corporation, International Airport Industrial Park, Tucson, Ariz., and the sample and hold circuits were of the type illustrated by Analog Devices SHH-18 manufactured by Analog Devices, P.O. Box 280, Norwood, Mass.

Figure 11:
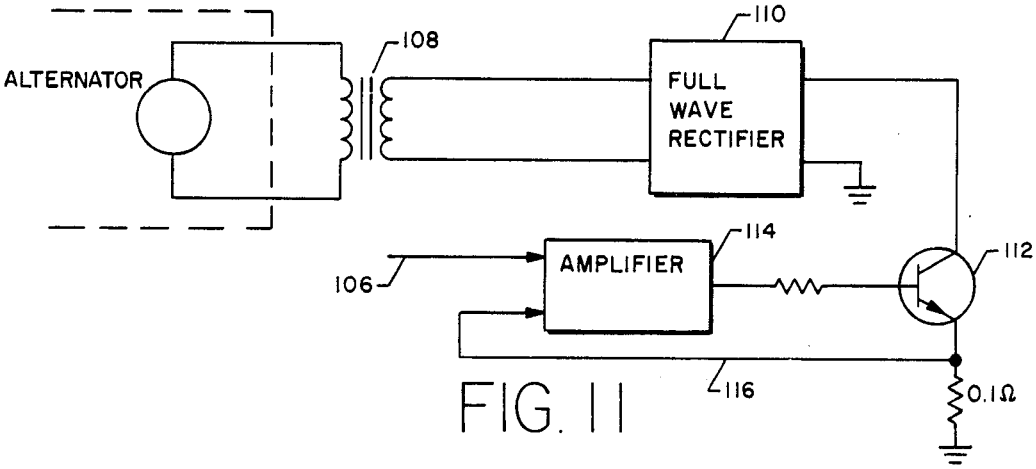
FIG. 11 is a block diagram of an alternator and control therefor as used in the block diagram of FIG. 6.

The alternator winding 16 and its associated circuit is illustrated in greater detail in FIG. 11. The output from the alternator 16 is applied via a transformer 108 to a full wave rectifier 110. A variable load 112 is coupled to the output of full wave rectifier 110. The load is varied through amplifier 114 having a feedback path 116 from the variable load. Amplifier 114 can be of the type illustrated by an Inland EM-1802 manufactured by Inland Motor, Redford, Va. The output from summer 104 of the comparator in FIG. 10 is applied to the input to amplifier 114 to vary the load. Changing the load on the windings changes the torque on the armature which, thus, reorientates the canard frame with respect to the main housing.

Figure 12:
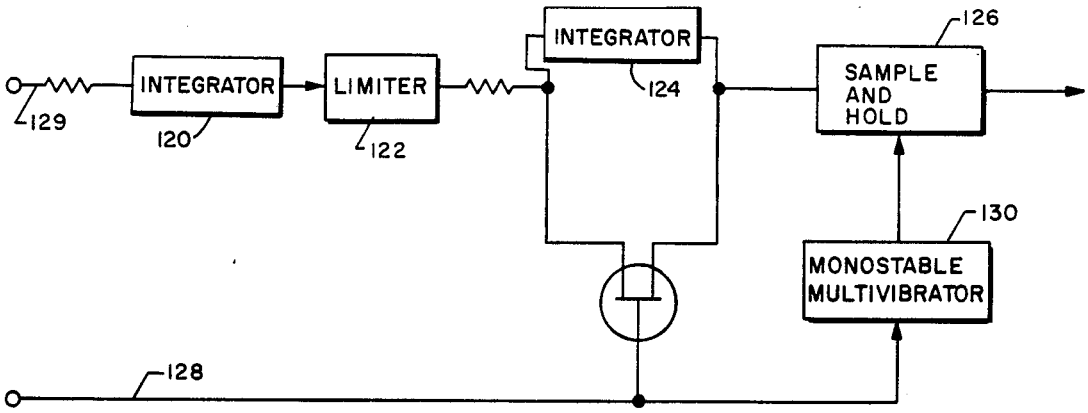
FIG. 12 is a block diagram of the means 63 of FIG. 6.

Block 63 of FIG. 6 is illustrated in block diagram format in FIG. 12. The differentiated signal applied on line 129 (see waveform B of FIG. 5) is integrated in an integrator 120 to provide a series of pulse which are limited by a limiter 122 to ensure that the amplitudes of all pulses are equal. The output from limiter 122 is applied to an integrator 124 whose output is a voltage proportional to the sum of the six pulse widths from integrator 120. The output from integrator 124 is held in a sample and hold circuit 126. This held value is directly proportional to the magnitude of the angle difference between the center line of the projectile (spin axis) and the line-of-sight to the target.

Integrator 124 is reset by an input thereto provided by a target reference pulse (see waveform C of FIG. 5) applied along a line 128. The sample and hold circuit is enabled by an output from a monostable multivibrator having a delay time equal to the period of the six pulses sensor output pulses. Multivibrator 130 is also triggered by the target reference pulse.

The fuzing and safing and arming for the device may be any of these available and no invention lies in any particular fuzing or safing and arming scheme.

While the present invention has been described in relation to a shipboard application, it may also be used on any projectile, whether land, sea or air launched. Also, while the guidance system has been described with particular electronics, other electronic systems may be used, as well understood by those skilled in the art. Thus it is to be understood that the embodiments shown are illustrative only and that many variations and modifications may be made without departing from the principles of the invention herein disclosed and defined by the appended claims.

What is claimed is:

1. Apparatus for providing guidance to intercept a target from a spinning projectile having deflectable canards thereon, comprising;

means for generating a first electrical signal which is proportional to the magnitude of the angle between the spin axis of the projectile and the line-of-sight to the target;

means coupled to said first signal generating means for generating a second electrical signal proportional to the rate of change of said first electrical signal;

means for generating a third electrical signal proportional to the angular rate of the projectile;

means for subtracting said third signal from said second signal to obtain an error signal; and means for coupling said error signal as a control to the deflectable canards.

2. Apparatus as defined in claim 1, wherein said means for generating a first electrical signal includes a rotating reticle for encoding the polarcoordinate position of a target image with respect to the spin axis of the projectile, a photodetector disposed to the rear of said reticle, means for differentiating the output from said detector and means for averaging the time intervals between positive and negative pulses of the differential signal over a period of time equal to one revolution of the projectile.

3. Apparatus as defined in claim 2, wherein said means for generating said second electrical signal includes means for differentiating the averaged signal.

4. Apparatus as defined in claim 1, wherein said means for generating a third signal includes a rate gyro.

5. Apparatus as defined in claim 1, wherein said coupling means includes means for amplifying said error signal.

6. Apparatus as defined in claim 5 wherein said coupling means further includes a motor electrically coupled to said amplifier and mechanically coupled to the deflectable canards.

* * * * *